US006616261B2

(12) United States Patent
Adkins et al.

(10) Patent No.: US 6,616,261 B2
(45) Date of Patent: Sep. 9, 2003

(54) AUTOMATIC BI-DIRECTIONAL ALIGNMENT METHOD AND SENSOR FOR AN INK JET PRINTER

(75) Inventors: Christopher Alan Adkins, Lexington, KY (US); Adam Jude Ahne, Lexington, KY (US); Mark Joseph Edwards, Lexington, KY (US); Renee Garcia, Jr., Suwanee, GA (US); Paul Harrington, III, Versailles, KY (US); Alexander Phillip Maroudis, Lexington, KY (US); Michael Anthony Marra, III, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/908,032

(22) Filed: Jul. 18, 2001

(65) Prior Publication Data

US 2003/0146949 A1 Aug. 7, 2003

(51) Int. Cl.[7] ..... B41J 2/01
(52) U.S. Cl. ..... 347/19
(58) Field of Search ..... 347/19, 37; 400/74

(56) References Cited

U.S. PATENT DOCUMENTS

| | | | | |
|---|---|---|---|---|
| 3,810,194 A | | 5/1974 | Tokunaga et al. | 346/75 |
| 4,092,591 A | | 5/1978 | Lozowski | 324/110 |
| 4,121,223 A | | 10/1978 | Omori et al. | |
| 4,333,083 A | | 6/1982 | Aldridge | |
| 4,346,389 A | | 8/1982 | Nagayama | |
| 4,509,057 A | | 4/1985 | Sohl et al. | 347/19 |
| 4,551,731 A | | 11/1985 | Lewis et al. | |
| 4,577,197 A | | 3/1986 | Crean et al. | |
| 4,737,803 A | | 4/1988 | Fujimura et al. | 346/140 |
| 4,768,045 A | | 8/1988 | Koto | 347/19 |
| 4,797,688 A | | 1/1989 | Furukawa | 347/6 |
| 4,818,129 A | | 4/1989 | Tanuma et al. | 400/323 |
| 4,990,932 A | | 2/1991 | Houston | 347/81 |
| 5,036,340 A | * | 7/1991 | Osborne | 347/19 |
| 5,040,003 A | | 8/1991 | Willis | |
| 5,160,938 A | | 11/1992 | Fargo et al. | |
| 5,160,939 A | | 11/1992 | Bajeux et al. | 347/78 |
| 5,164,747 A | | 11/1992 | Osada et al. | 346/140 |
| 5,241,325 A | | 8/1993 | Nguyen | |
| 5,276,467 A | | 1/1994 | Meyer et al. | |
| 5,534,895 A | | 7/1996 | Lindenfelser et al. | |
| 5,561,449 A | | 10/1996 | Raskin et al. | |
| 5,696,842 A | | 12/1997 | Shirasawa et al. | |
| 5,721,574 A | | 2/1998 | Kubby | 347/7 |
| 5,739,832 A | | 4/1998 | Heinzl et al. | 347/68 |
| 5,751,305 A | | 5/1998 | Hadley | |
| 5,771,051 A | | 6/1998 | Guenther et al. | |
| 5,796,414 A | | 8/1998 | Sievert et al. | |
| 5,815,175 A | | 9/1998 | Seikel | 347/23 |
| 5,847,722 A | | 12/1998 | Hackleman | |
| 5,883,646 A | | 3/1999 | Beauchamp | 347/19 |
| 5,929,875 A | | 7/1999 | Su et al. | 347/19 |
| 5,936,645 A | | 8/1999 | Niikura et al. | 347/14 |
| 5,975,674 A | | 11/1999 | Beauchamp et al. | |
| 5,984,455 A | | 11/1999 | Anderson | 347/47 |
| 5,992,984 A | | 11/1999 | Imanaka et al. | 347/65 |
| 5,995,067 A | | 11/1999 | Terasawa et al. | 345/23 |
| 6,007,173 A | | 12/1999 | DeLouise et al. | 347/7 |
| 6,010,201 A | | 1/2000 | Shimoda | 347/7 |
| 6,039,429 A | * | 3/2000 | Balousek | 347/19 |
| 6,048,046 A | | 4/2000 | Saito et al. | 347/19 |
| 6,062,668 A | | 5/2000 | Cruz-Uribe | |
| 6,084,607 A | | 7/2000 | Matsuda | |
| 6,109,721 A | | 8/2000 | Kim | |
| 6,109,722 A | | 8/2000 | Underwood et al. | |
| 6,250,735 B1 | | 6/2001 | Kaneko et al. | 347/19 |
| 6,299,275 B1 | | 10/2001 | Elgee | 347/19 |
| 6,378,978 B1 | | 4/2002 | Chang et al. | 347/19 |
| 6,398,334 B2 | | 6/2002 | Dunand | 347/14 |

* cited by examiner

*Primary Examiner*—Craig Hallacher
(74) *Attorney, Agent, or Firm*—Taylor & Aust, P.C.

(57) ABSTRACT

A printhead alignment sensor for an ink jet printer includes two terminals defining a substantially linear gap therebetween. An ink support device supports ink in the gap between the terminals. An electrical measuring device detects a change in an electrical resistance between the terminals when ink is supported in the gap by the ink support device.

33 Claims, 14 Drawing Sheets

AUTOMATIC BI-DIRECTIONAL ALIGNMENT METHOD AND SENSOR FOR AN INK JET PRINTER

BACKGROUND OF THE INVENTION

1. Field of the Invention

The present invention relates to a method and apparatus for print alignment in an ink jet printer, and, more particularly, to a method and apparatus for bi-directional print alignment in an ink jet printer.

2. Description of the Related Art

When an ink jet printer prints the same horizontal print line (swath) in both left and right-going directions of the carrier, errors are induced due to the travel time of the ink droplets and cock of the carrier due to play in the carrier attachment. As illustrated in FIG. 1, the momentum of a left-going carrier 30 causes ink droplets 32 ejected by a printhead 34 to be carried leftward, resulting in a flight time error 36. Similarly, the momentum of a right-going carrier 30 causes ink droplets 32 ejected by printhead 34 to be carried rightward, resulting in a flight time error 38 (FIG. 2). That is, without alignment, ejecting a vertical column of dots at a given physical encoder marking results in a printed column positioned to the left of the encoder marking location when the carrier is left-going, and results in a printed column positioned to the right of the encoder marking location when the carrier is right-going. In order to eliminate or reduce flight time errors, printers that feature bi-directional print modes must adjust print timing such that the columns of the above example converge on a single location.

Many printers include a manual method of doing "bi-directional alignment". Usually, this involves the printer driver printing a test page which includes a continuum of alignment possibilities, and having the user manually type in at their personal computer a number or letter representing the pattern with best alignment. From this input, the driver saves timing offsets that allow left and right-going print to align properly.

Automatic bi-directional alignment methods have been featured in a few recent photo-quality ink-jet printers and plotters. Known methods of automatic bi-directional alignment are expensive and include a printed test pattern page scanned by an optical sensor residing on the carrier.

What is needed in the art is a low-cost, simplified bi-directional alignment sensor and, more generally, a simplified bi-directional alignment method.

SUMMARY OF THE INVENTION

The present invention provides a low-cost, simple sensor and method for performing bi-directional alignment in an ink jet printer.

The invention comprises, in one form thereof, a printhead alignment sensor for an ink jet printer including two terminals defining a substantially linear gap therebetween. An ink support device supports ink in the gap between the terminals. An electrical measuring device detects a change in an electrical resistance between the terminals when ink is supported in the gap by the ink support device.

The invention comprises, in another form thereof, a method of bi-directionally aligning a printhead in an ink jet printer. A substrate is provided having a target area with a width approximately equal to a width of an ink drop. A carrier of the printhead is moved in a first scan direction from a first location toward the target area. A plurality of aligned ink drops are jetted from the printhead when the carrier is at a first directional jetting location. The aligned ink drops are substantially parallel to the target area. Whether at least one of the ink drops has been jetted onto the target area is sensed. The carrier is returned to the first location. The moving, jetting, sensing and returning steps are repeated until at least one of the ink drops has been jetted onto the target area. Each first directional jetting location is closer to the target area than an immediately preceding first directional jetting location. A first reference jetting location of the carrier is recorded. The first reference jetting location is a location of the carrier when it is sensed that at least one of the ink drops has been jetted onto the target area while the carrier is moving in the first scan direction. The carrier is moved in a second scan direction from a second location toward the target area. The second scan direction is substantially opposite to the first scan direction. A plurality of aligned ink drops are jetted from the printhead when the carrier is at a second directional jetting location. The aligned ink drops are substantially parallel to the target area. Whether at least one of the ink drops has been jetted onto the target area is sensed. The carrier is returned to the second location. The second moving, jetting, sensing and returning steps are repeated until at least one of the ink drops has been jetted onto the target area. Each second directional jetting location is closer to the target area than an immediately preceding second directional jetting location. A second reference jetting location of the carrier is recorded. The second reference jetting location is a location of the carrier when it is sensed that at least one of the ink drops has been jetted onto the target area while the carrier is moving in the second scan direction. The first reference jetting location and the second reference jetting location are used to align ink jetted from the printhead when the carrier is moving in the first scan direction with ink jetted from the printhead when the carrier is moving in the second scan direction.

An advantage of the present invention is that the cost of the sensor is much less than that of a reflective, optical type sensor. The sensing circuit requires just a few low cost components, and the method allows high accuracy of alignment at little cost.

Another advantage is that the method requires only a rough alignment of the sensor in the printer for ease of printer manufacturing assembly.

Yet another advantage is that the method allows alignment to be performed without printing a test page. No user interaction is required. The alignment may take place automatically as soon as a new printhead is identified as having been installed.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
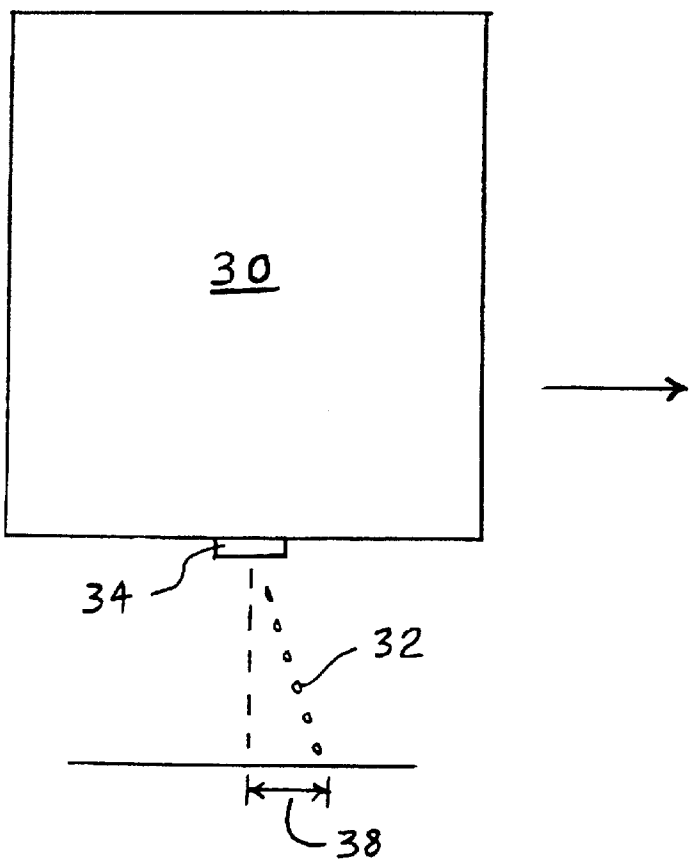
FIG. 2 is a schematic side view of a right-going printer carrier ejecting ink drops.
Figure 1:
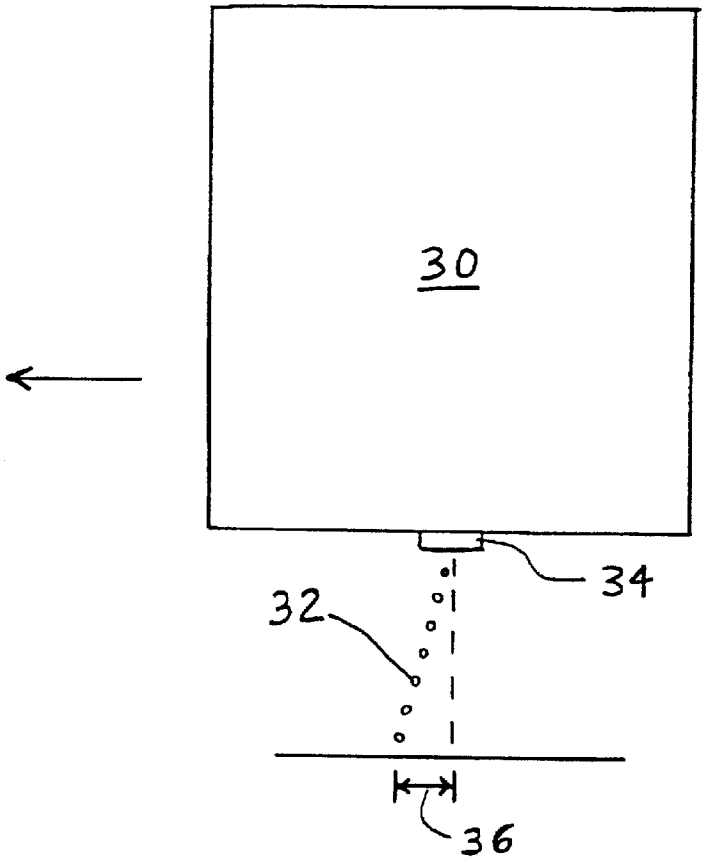
FIG. 1 is a schematic side view of a left-going printer carrier ejecting ink drops.
Figure 3:
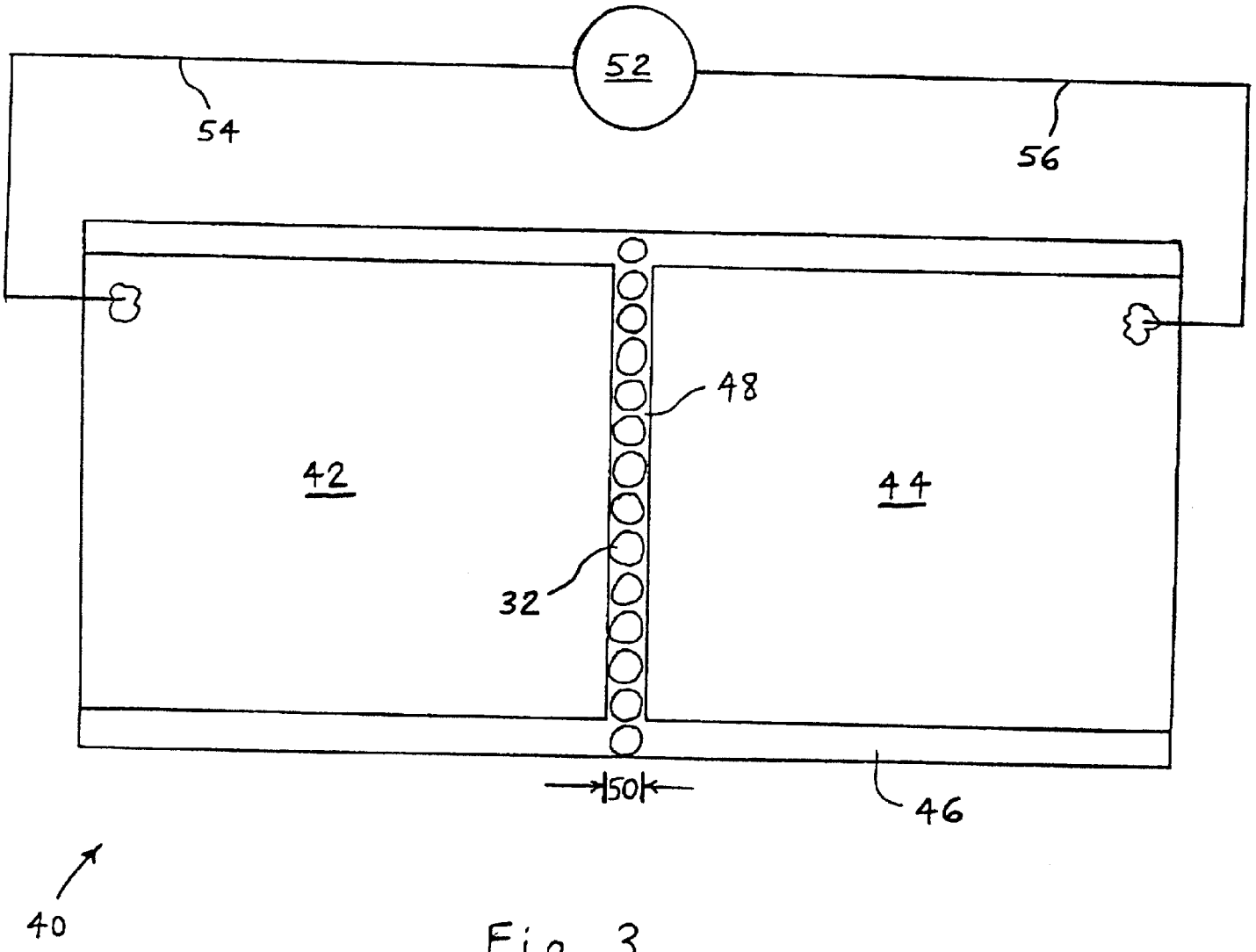
FIG. 3 is an overhead schematic view of one embodiment of a slotted sensor of the present invention.

In FIG. 3 there is shown one embodiment of a slotted sensor 40 of the present invention, including two copper terminals 42, 44 on a mylar substrate 46. Terminals 42, 44 are separated by a gap 48 having a width 50 of approximately 1/600-inch, which is approximately the width of an ink droplet 32. Gap 48 can be formed by laser cutting. An ohmmeter 52 has leads 54, 56 connected to terminals 42, 44, respectively, to measure the resistance therebetween. When no ink drops 32 are between terminals 42 and 44, the resistance between terminals 42 and 44 is many hundreds of megohms. If a single column of ink dots 32 is printed from printhead 34 into gap 48, as illustrated in FIG. 3, the resistance between terminals 42, 44 drops into the range of approximately between 0.5 and 3 megohms. Printing this column of ink drops 32 even one print element (pel) off-center of gap 48 leaves the resistance between terminals 42, 44 at several hundred megohms. One pel is defined herein as the width of one ink droplet. Once printed in gap 48, the ink evaporates within a few seconds, and the resistance returns to several hundred megohms. Thus, slotted sensor 40 is reusable, i.e., it may be used for several alignment print passes.

Figure 4:
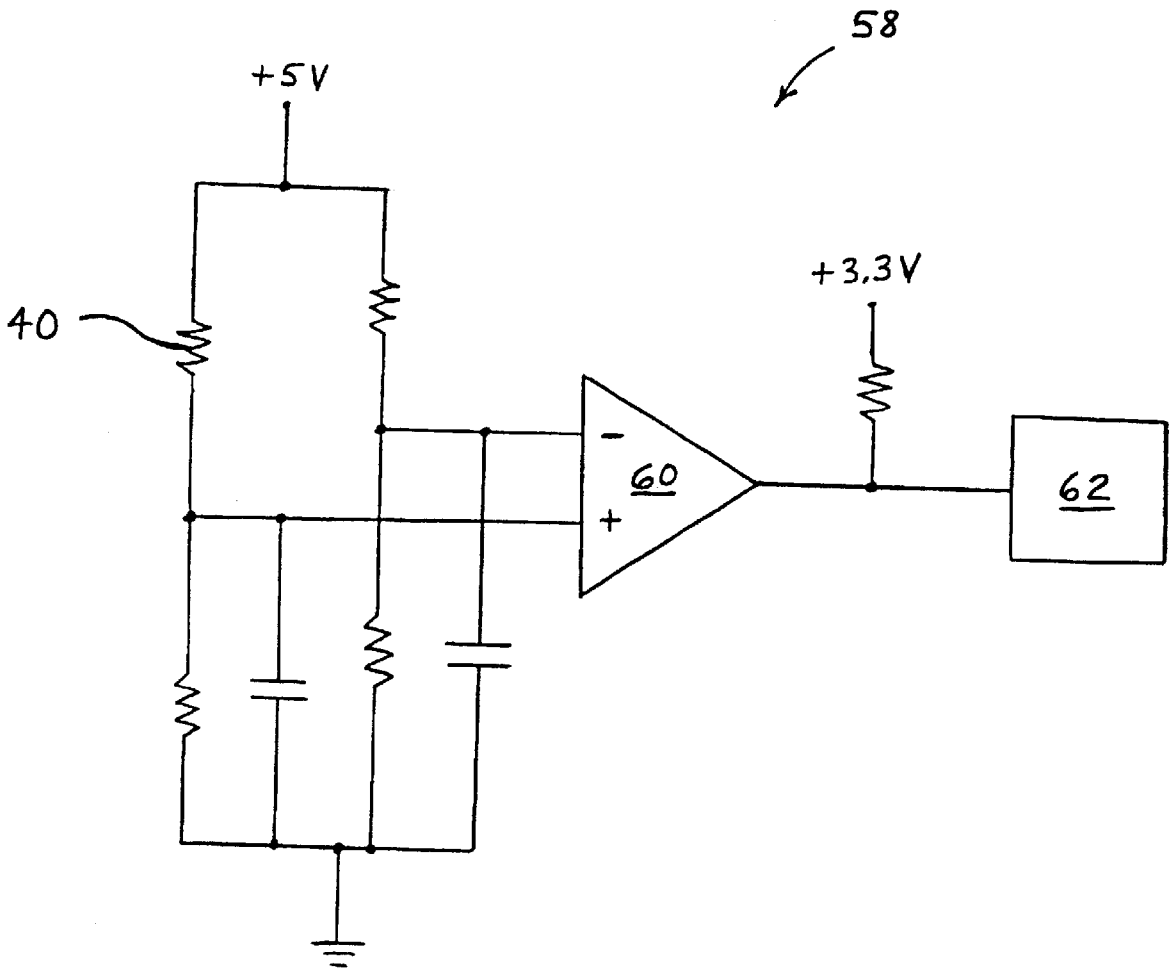
FIG. 4 is a schematic view of one embodiment of a sensing circuit in which the sensor of FIG. 3 can be incorporated.

Slotted sensor 40 can be incorporated in a sensing circuit 58, as shown in FIG. 4. The resistance of sensor 40 is used in a resistor divider in a comparator circuit such that its change from several hundred megohms to just a few megohms causes the output of comparator 60 to go high. This output is fed to the printer application specific integrated circuit (ASIC) 62 to indicate that the printed dot column has been printed in gap 48 of sensor 40.

Figure 5:
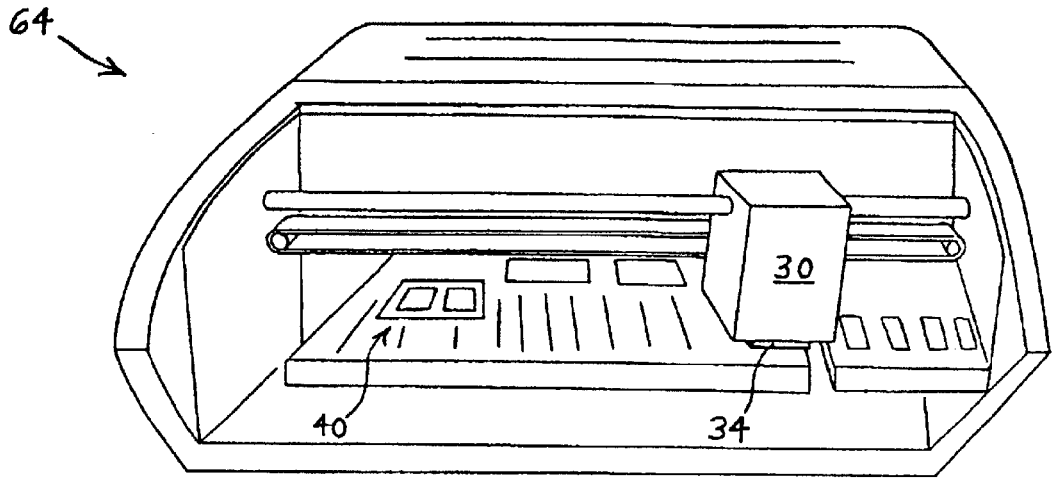
FIG. 5 is a front, sectional, perspective view of an ink jet printer including the sensing circuit of FIG. 4.

One embodiment of the bi-directional alignment method of the present invention includes positioning sensor 40 in the horizontal print path of carrier 30, in an approximate position specified in software. This approximate position of sensor 40 within an ink jet printer 64 (FIG. 5) is typically known to perhaps 1/8-inch.

Figure 6:
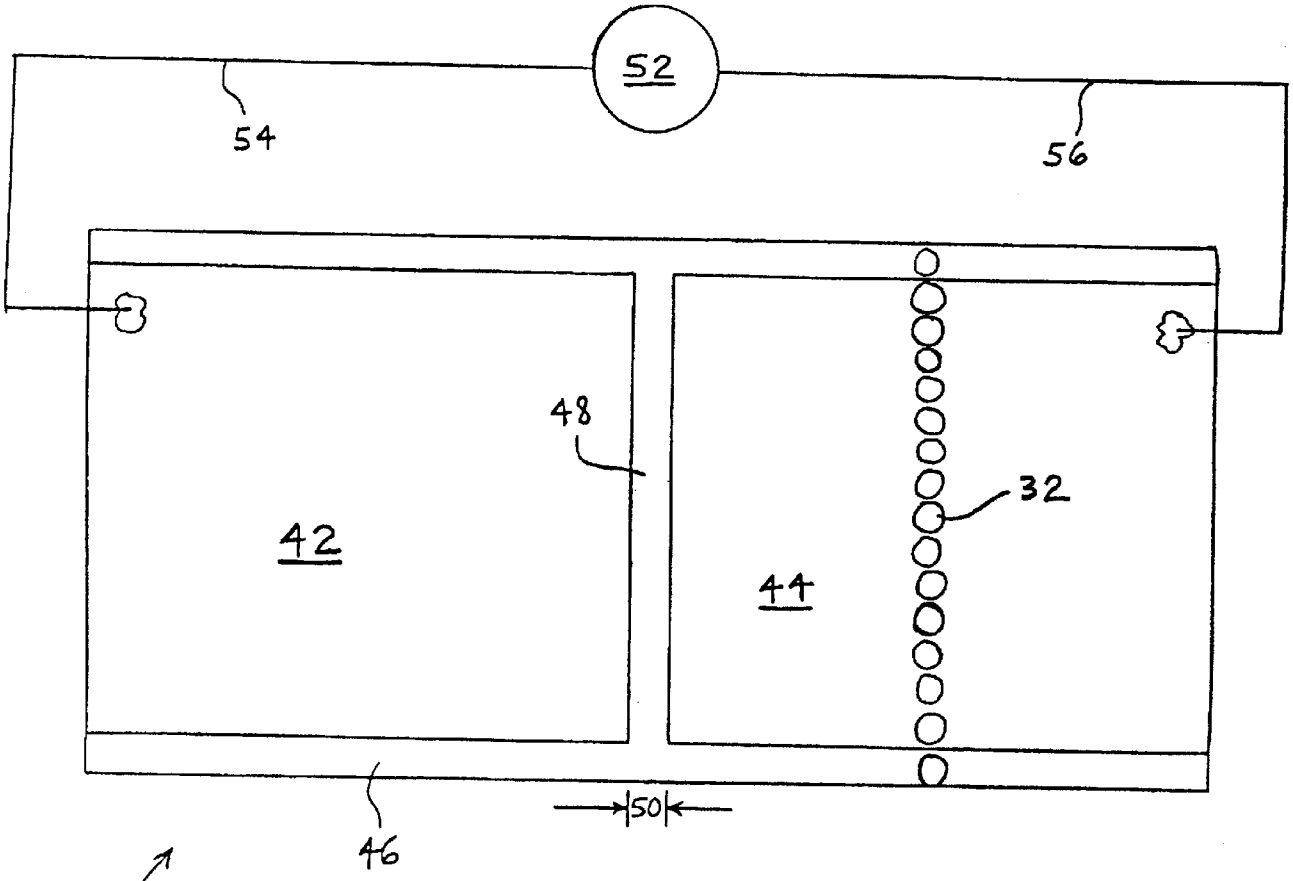
FIG. 6 is an overhead schematic view of the slotted sensor of FIG. 3 with a column of dots printed to the right of the gap.

In a next step of the method, carrier 30 moves leftward, and printer 64 prints a single-pel-wide column of dots 32 somewhat to the right of sensor gap 48, as shown in FIG. 6. The column of dots can be printed just to the right of the left edge of terminal 44, perhaps several pels away from gap 48, but in an amount that is known to ensure that the column will be positioned to the right of gap 48. Carrier 30 is then returned to the far right.

With carrier 30 again moving leftward, printer 64 prints a single-pel-wide column of dots one pel further to the left than the previous column. Sensor 40 is monitored by ohmmeter 52 to determine whether the column is printed in gap 48, or on the left edge of terminal 44. If not, carrier 30 is returned to the far right and the above procedure is repeated such that increasingly leftward columns of dots are printed until gap 48 or the left edge of terminal 44 is located. If gap 48 or the left edge of terminal 44 is not located within a maximum number of tries, a dead sensor or other error is indicated.

Figure 7:
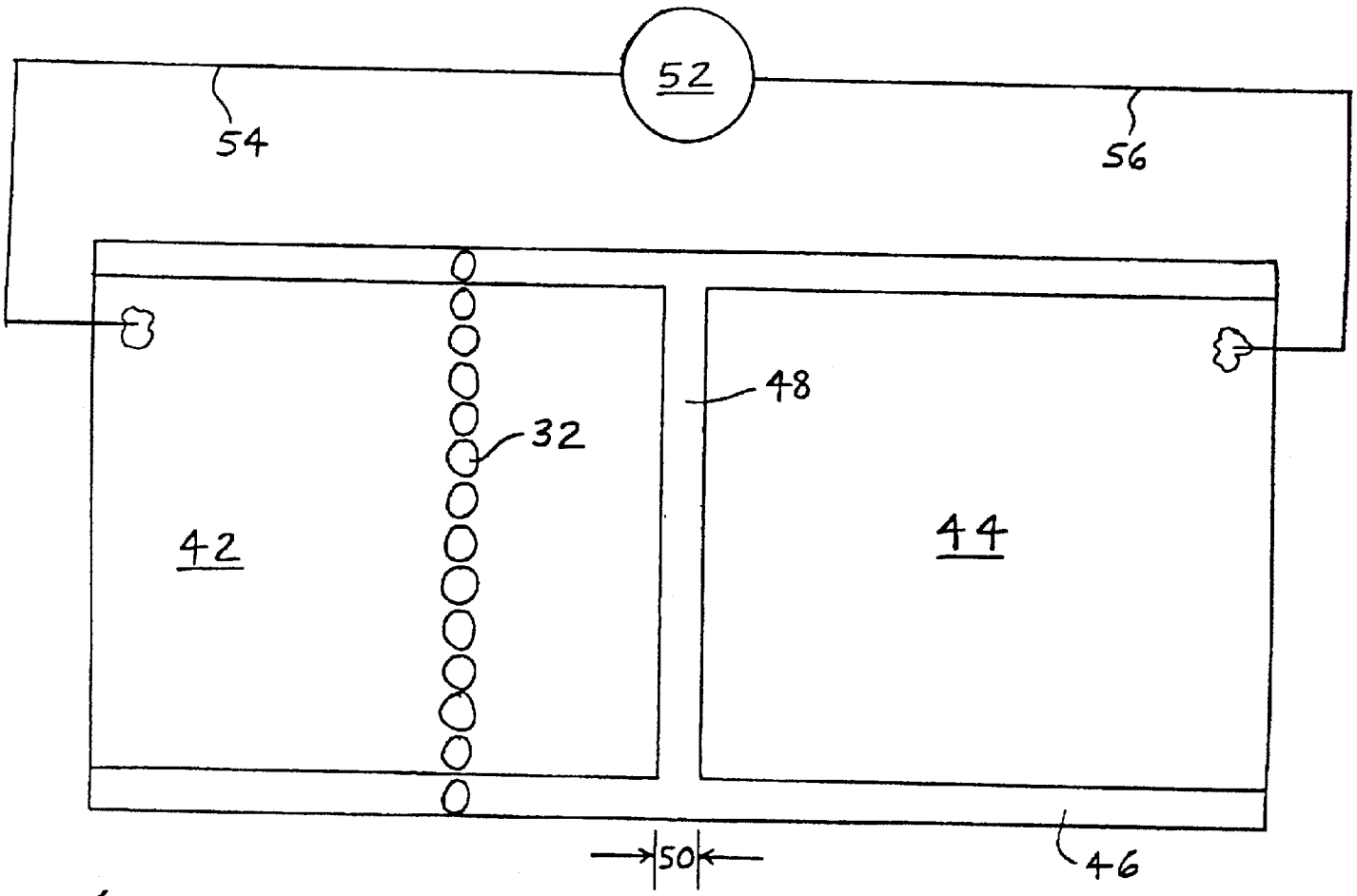
FIG. 7 is an overhead schematic view of the slotted sensor of FIG. 3 with a column of dots printed to the left of the gap.

Once gap 48 has been located, a known encoder position is recorded as the position a left-going carrier 30 must be in to print within sensor gap 48. Carrier 30 is then relocated to the far left position. With carrier 30 now moving rightward, printer 64 prints a single-pel-wide column of dots somewhat to the left of sensor gap 48, as shown in FIG. 7. The column of dots can be printed just to the left of the right edge of terminal 42, perhaps several pels away from gap 48, but in an amount that is known to ensure that the column will be positioned to the left of gap 48. Carrier 30 is then returned to the far-left.

With carrier 30 again moving rightward, printer 64 prints a single-pel-wide column of dots one pel further to the right than the previous column. Sensor 40 is monitored by ohmmeter 52 to determine whether the column is printed in gap 48, or on the right edge of terminal 42. If not, carrier 30 is returned to the far-left and the above procedure is repeated such that increasingly rightward columns of dots are printed until gap 48 or the right edge of terminal 42 is located. If gap 48 or the right edge of terminal 42 is not located within a maximum numbers of tries, a dead sensor or other error is indicated.

Once gap 48 has been located, a known encoder position is recorded as the position a right-going carrier 30 must be in to print within sensor gap 48. Offsets are then calculated based on the encoder positions recorded for left and right-going print and are used to correct subsequent print swaths.

The method above has been described with a left-going carrier printing to the right of the sensor gap, and a right-going carrier printing to the left of the sensor gap. However, it is to be understood that the present invention may include a left-going carrier printing to the left of the gap and then moving incrementally moving to the right to locate the gap.

Similarly, a right-going carrier may print to the right of the gap and then move incrementally to the left to locate the gap.

The method described above is independent of the type of sensing device used. That is, given any sensor capable of denoting when a single-pel column of dots has been printed onto a given single-pel-wide print position or sensor edge, the above-described method may be used to perform bi-directional alignment.

Figure 8:
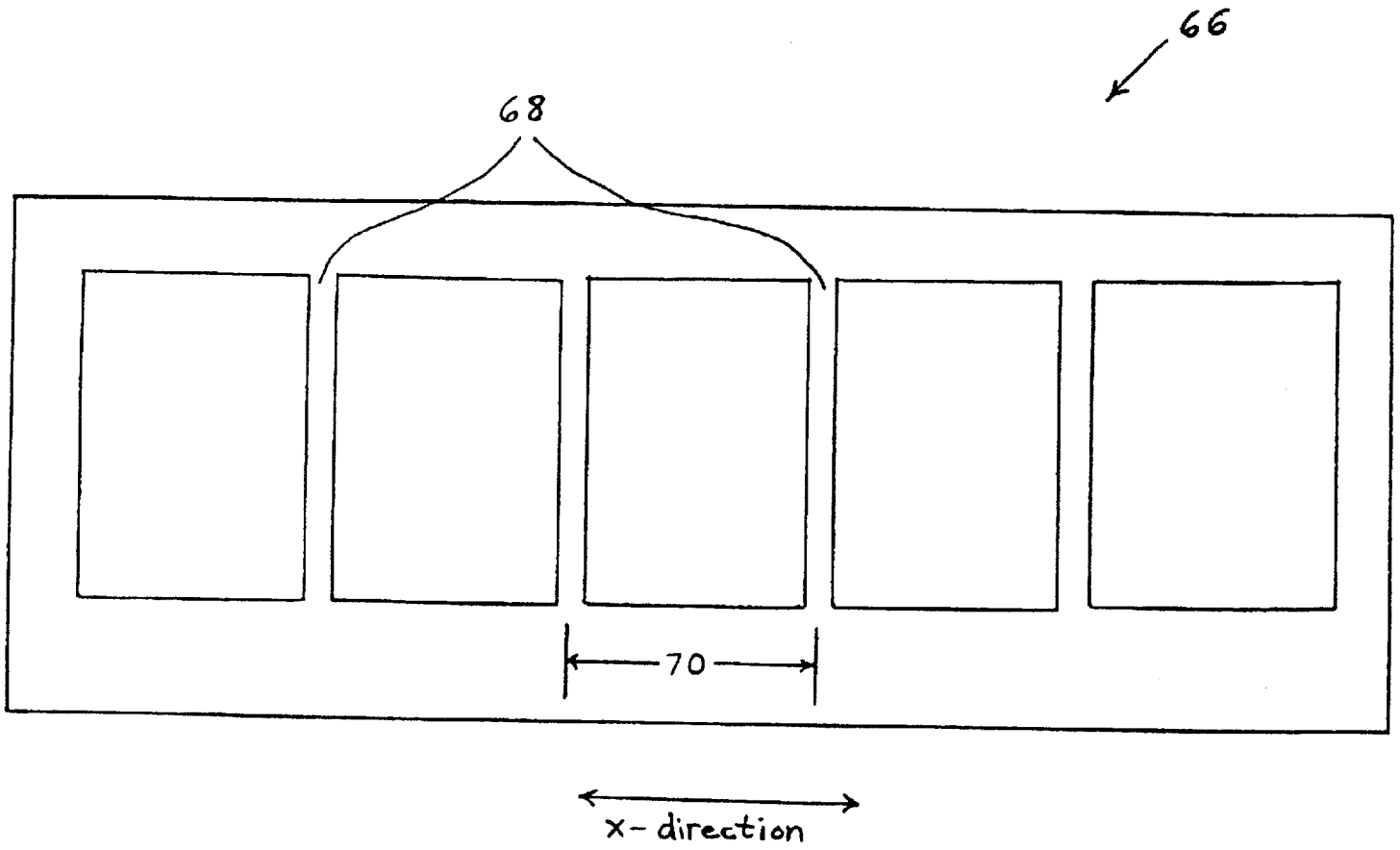
FIG. 8 is an overhead schematic view of another embodiment of a slotted sensor of the present invention.

In another embodiment, a non-reusable gap resistance sensor 66 (FIG. 8) has two or more gap positions. Each gap 68 is one pel wide and is separated from adjacent gaps 68 by a distance 70 in an x-direction. Distance 70 is equal to an integer multiple of the width of a pel.

Figure 9:
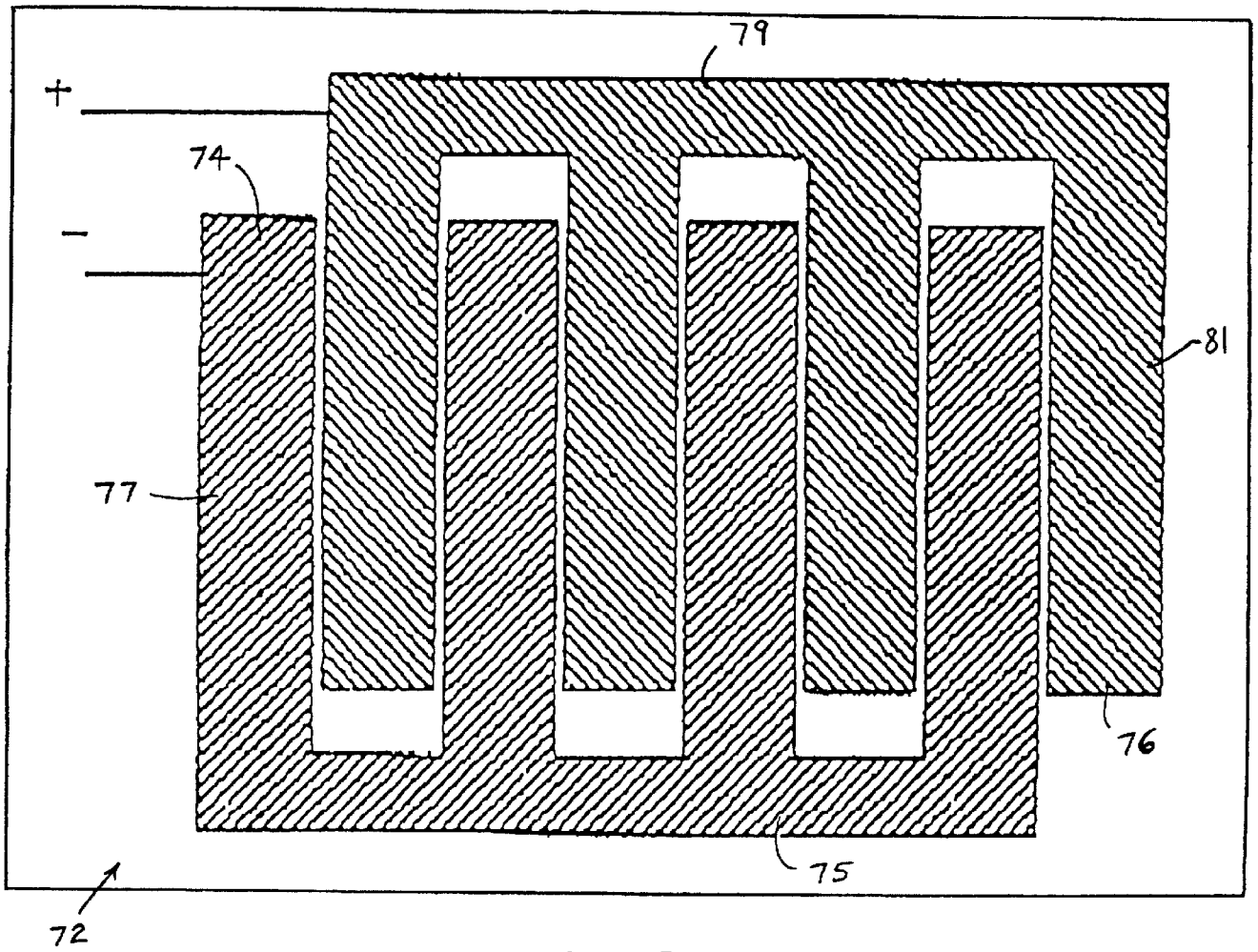
FIG. 9 is an overhead schematic view of yet another embodiment of a slotted sensor of the present invention.

In yet another embodiment, a redundant sensor 72 (FIG. 9) operates similarly to sensor 40. Terminal 74 includes a base 75 with tines 77 extending therefrom. Similarly, terminal 76 includes a base 79 with tines 81 extending therefrom. The resistance between terminals 74 and 76 is reduced when a dot column is aligned in a gap therebetween. The method used in conjunction with sensor 72 is similar to that described above except that multiple columns are printed on each pass.

Figure 10:
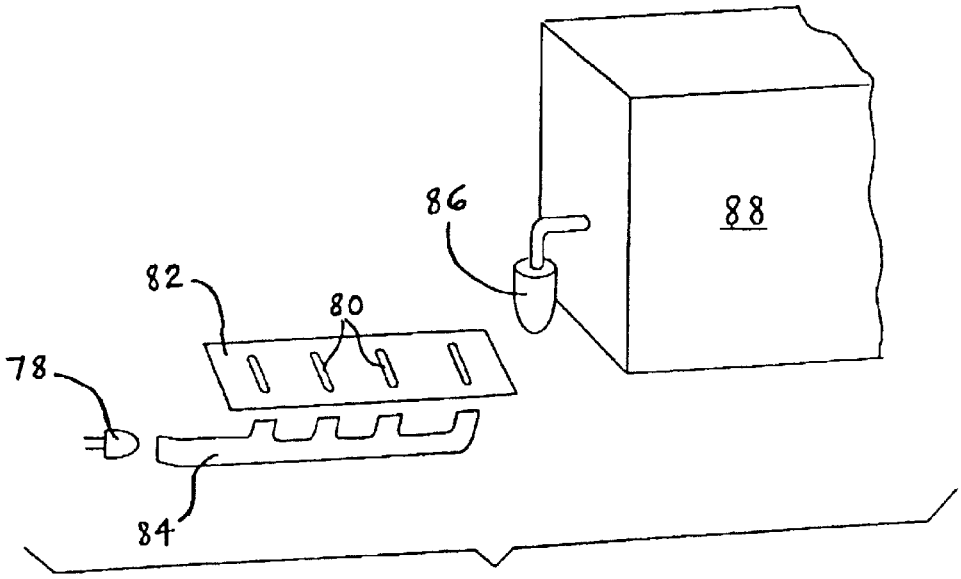
FIG. 10 is an exploded, perspective view of a further embodiment of a slotted sensor of the present invention.

In a further embodiment (FIG. 10), an LED emitter 78 shines light through one-pel-wide areas 80 in a transparent cover 82 via a light pipe 84, and the light is sensed with a detector 86 mounted on a carrier 88. A one-pel-wide column of ink drops is printed on cover 82 over an area 80, blocking the light. When the light is blocked, the print position in the x-direction is known. Each area 80 is separated from adjacent areas 80 by an integer multiple number of pel widths.

Figure 11:
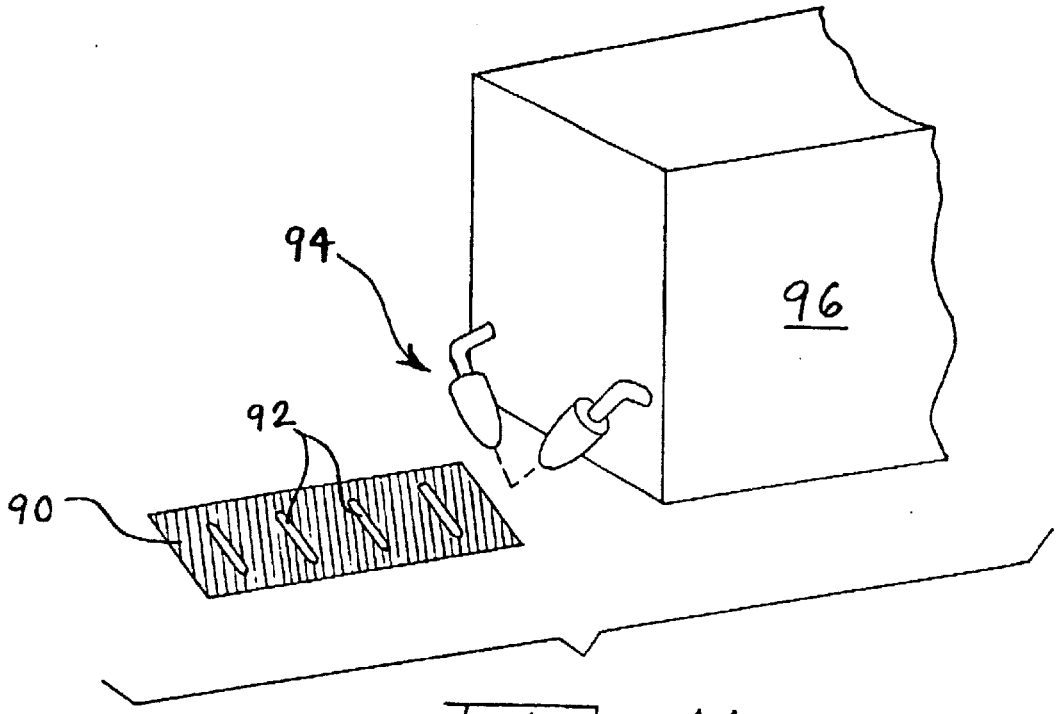
FIG. 11 is a perspective view of a still further embodiment of a slotted sensor of the present invention.

In a still further embodiment (FIG. 11), a black label 90 with one-pel-wide white bars 92 is sensed with a reflective sensor 94 mounted on a carrier 96. A one-pel-wide column of ink drops is printed onto white bar 92. When white is no longer sensed by sensor 94, the print position of carrier 96 in the x-direction is known.

Figure 12:
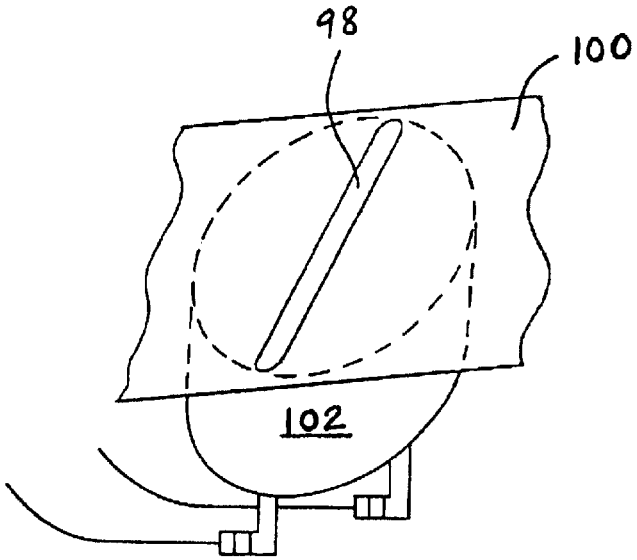
FIG. 12 is an overhead view of another embodiment of a slotted sensor of the present invention.

In another embodiment (FIG. 12), a one-pel-wide slot or opening 98 is provided in a platen 100 over a sensor 102. Thus, platen 100 functions as a mask. Sensor 102 may be pressure sensitive, vibration sensitive, or a humidity sensor. When a one-pel-wide printed column of ink drops is printed through slot 98 and impinges upon sensor 102, the print position in the x-direction is known. This detection device is reusable.

In yet another embodiment, an edge of a pressure sensor is suspended in a printable zone. A one-pel-wide column of ink drops is initially spit a distance away from the edge of the sensor. The column of ink drops is then spit closer to the sensor, in one-pel increments, until the ink starts to impinge upon the sensor edge. The edge of the sensor provides the needed known position in the x-direction. This embodiment is reusable and inexpensive.

Figure 13:
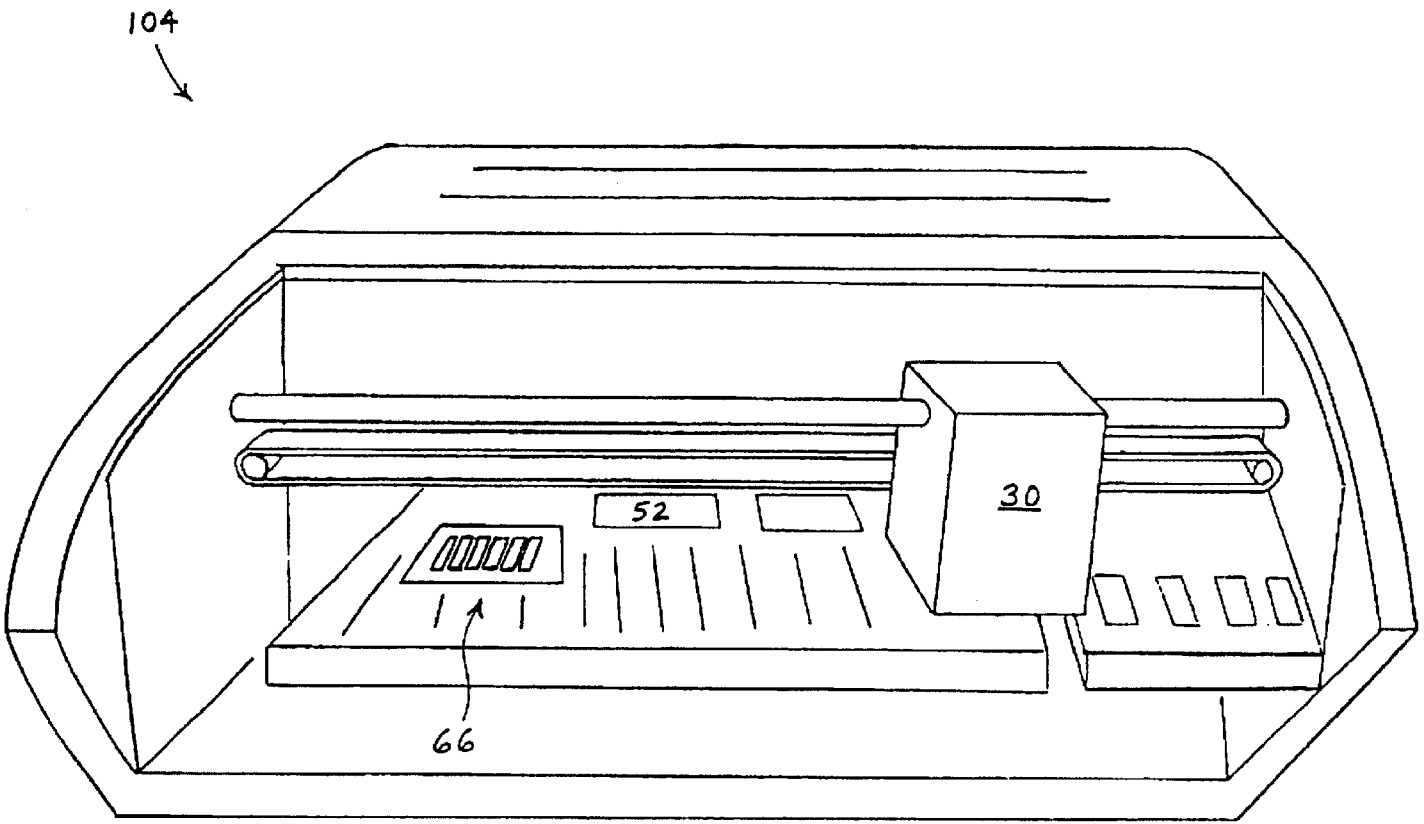
FIG. 13 is a front, sectional, perspective view of an ink jet printer including the slotted sensor of FIG. 8.

In an alternative embodiment of a bi-directional alignment method, as shown in FIG. 13, the non-re-usable sensor 66 senses that a printed left-going, one-pel-wide column of ink drops has impinged upon a first fixed x position, and that a printed right-going, one-pel-wide column of ink drops has struck a second fixed x position. The first and second fixed x positions are separated from each other in the x-direction a known integer number of pel widths. In a first step of performing bi-directional alignment, the sensor is positioned in the horizontal print path of the carrier, in an approximate position specified in software. This approximate position is typically known to perhaps ⅛-inch, and can be the same as the position of sensor 40 in FIG. 5.

With carrier 30 moving leftward, printer 104 (FIG. 13) prints a single-pel-wide column of dots somewhat to the right of the right-most sensor gap 68, perhaps several pels away from right-most gap 68, but in an amount that is known to ensure that the column will print to the right of right-most gap 68. Carrier 30 is then returned to the far right.

With carrier 30 left-going, printer 104 prints a single-pel-wide column of dots one pel further to the left than the previous column. Sensor 66 is monitored to see if the column hits right-most gap 68. If not, carrier 30 is returned to the far right and the above procedure is repeated such that increasingly leftward columns of dots are printed until right-most gap 68 is located. If right-most gap 68 is not located within a maximum numbers of tries, a dead sensor or other error is indicated.

Once right-most gap 68 has been located, a known encoder position is recorded as the position a left-going carrier 30 must be in to print within sensor gap 68. Carrier 30 is then relocated to the far left position. With carrier 30 now moving rightward, printer 104 prints a single-pel-wide column of dots somewhat to the left of the second right-most sensor gap 68. The column of dots can be printed perhaps several pels away from second right-most gap 68, but in an amount that is known to ensure that the column will be positioned to the left of second right-most gap 68. Carrier 30 is then returned to the far-left.

With carrier 30 again moving rightward, printer 104 prints a single-pel-wide column of dots one pel further to the right than the previous column. Sensor 66 is monitored by ohmmeter 52 to determine whether the column is printed in second right-most gap 68. If not, carrier 30 is returned to the far-left and the above procedure is repeated such that increasingly rightward columns of dots are printed until second right-most gap 68 is located. If second right-most gap 68 is not located within a maximum numbers of tries, a dead sensor or other error is indicated.

Once second right-most gap 68 has been located, a known encoder position is recorded as the position a right-going carrier 30 must be in to print within second right-most sensor gap 68. Offsets are then calculated based on the encoder positions recorded for left and right-going print and are used to correct subsequent print swaths.

Cabling and connectors of the sensor of the present invention are simplified and cost-reduced as compared to an optical sensor because the sensor has only two terminals. The sensor base is small and can be made many-up with standard flex-cable manufacturing methods, then processed through a laser cut process to make the slot.

Figure 14:
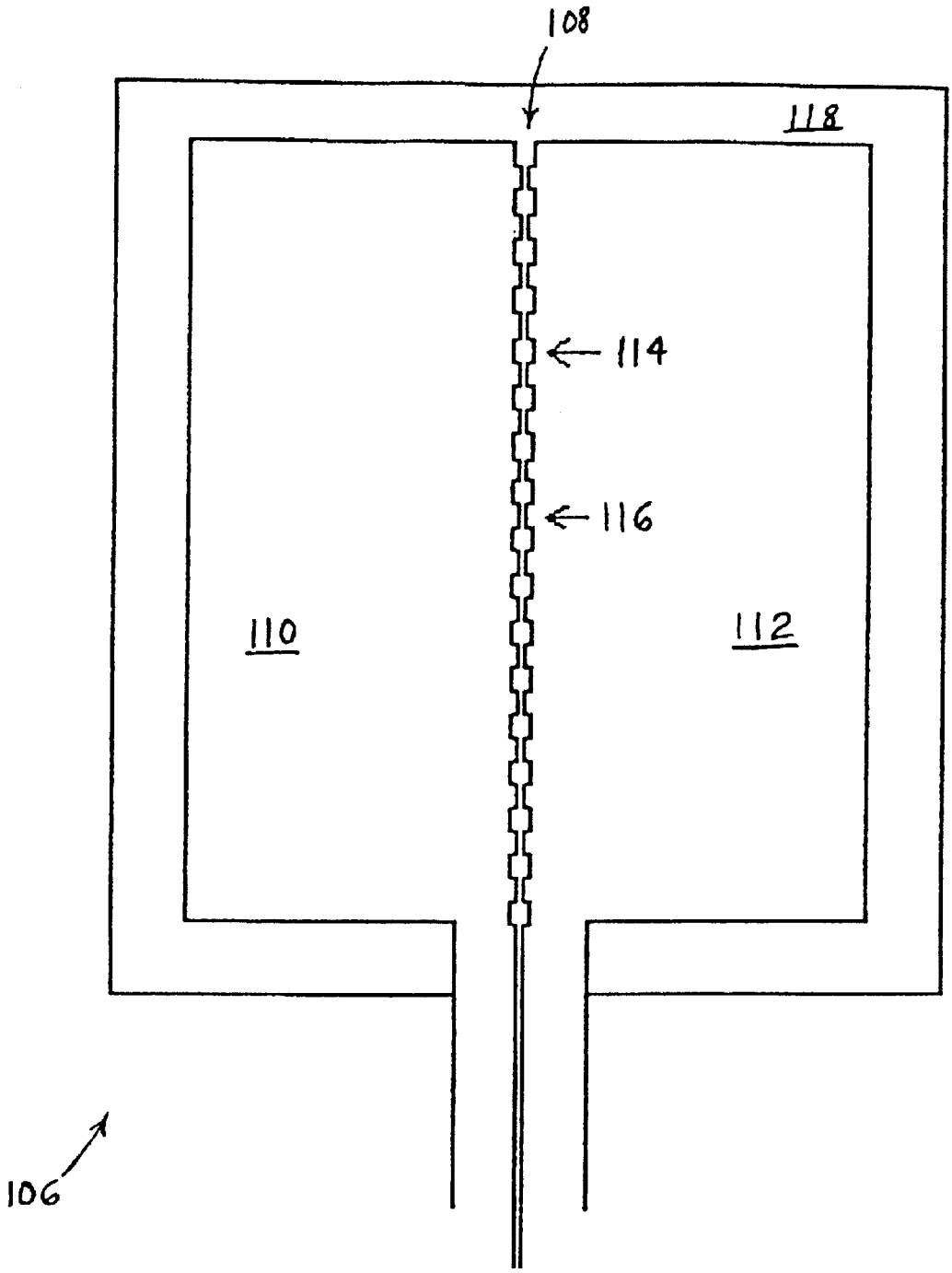
FIG. 14 is an overhead view of yet another embodiment of a slotted sensor of the present invention.

Another embodiment of a slotted sensor 106 of the present invention is shown in FIG. 14. A gap 108 between terminals 110, 112 has alternating wider sections 114 and narrower section 116 to accommodate black ink drops and color ink drops, respectively. Terminals 110, 112 are mounted on and supported by substrate 118.

Black ink has a greater dot size than does color ink (75 microns for black and 50 microns for the color), therefore when a swath of black ink that is one pel wide and 192 nozzles tall is printed versus a color swath that is one pel wide and 64 nozzles tall, inconclusive results may be obtained on the same gap. The results are inconclusive in that as the sensor is traversed in 1/1200-inch increments, a specific range of consecutive swaths for each ink (black and color) can be detected within the gap. For example, the black may have a range of thirteen consecutive print swaths that will trigger on one gap size, but if the gap size is increased, perhaps only five or six consecutive print swaths will trigger on the gap size. The same results can be obtained in the color as well, but a side effect occurs due to the increased gap size.

The ink must be accumulated or built up to allow the signal to be seen. The increased gap size also decreases the signal strength. Another factor that the varying gap size affects is dry time, i.e., the time required for the sensor to return to an initial state. With an increase in the gap size, less time is required for the dots laid down to dry up and for the sensor to return to its initial state. The reason for this decrease in dry time is the fact that the same volume of water that is in the ink dots dries faster with an increase in surface area. In this case, a bigger gap size sensor has a greater surface area, thus it has a quicker dry time. This in turn reduces the time required to perform automatic alignment or provide quick and accurate results to the end user [customer], and uses less ink in the process.

Another benefit of the increased gap size is the number of times that an automatic alignment can be performed on a sensor before the sensor becomes useless. Every time a swath is printed in the gap region, a buildup of ink accumulates therein, which can increase the dry time and decrease the life span of the sensor. With the bigger gap, the same amount of build up can occur as in the smaller gap, but the effect is not as significant.

The bigger gap size is fine for the black ink dots, however it presents problems with the color ink dots. Since the color dots require a buildup to trigger the gap sensor, a sensor with a smaller gap is needed. The smaller gap allows the smaller color dots to trigger the sensor on the first swath pass that is printed within the gap because there is less area for the dots to cover. To further optimize the reliability and life of the gap sensor, the number of dots that is used for color and black can be changed. This change could be a decrease in dot count, or just a change in how the dots are positioned. A decrease in dot count allows a faster dry time and less buildup on the sensor, which increases the gap sensor's life. The positioning of the dots allows variability in the pattern used in the swath.

Figure 16:
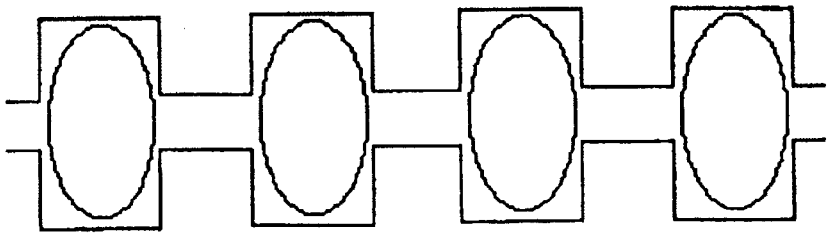
FIG. 16 is an enlarged, fragmentary, overhead view of the sensor of FIG. 15.
Figure 15:
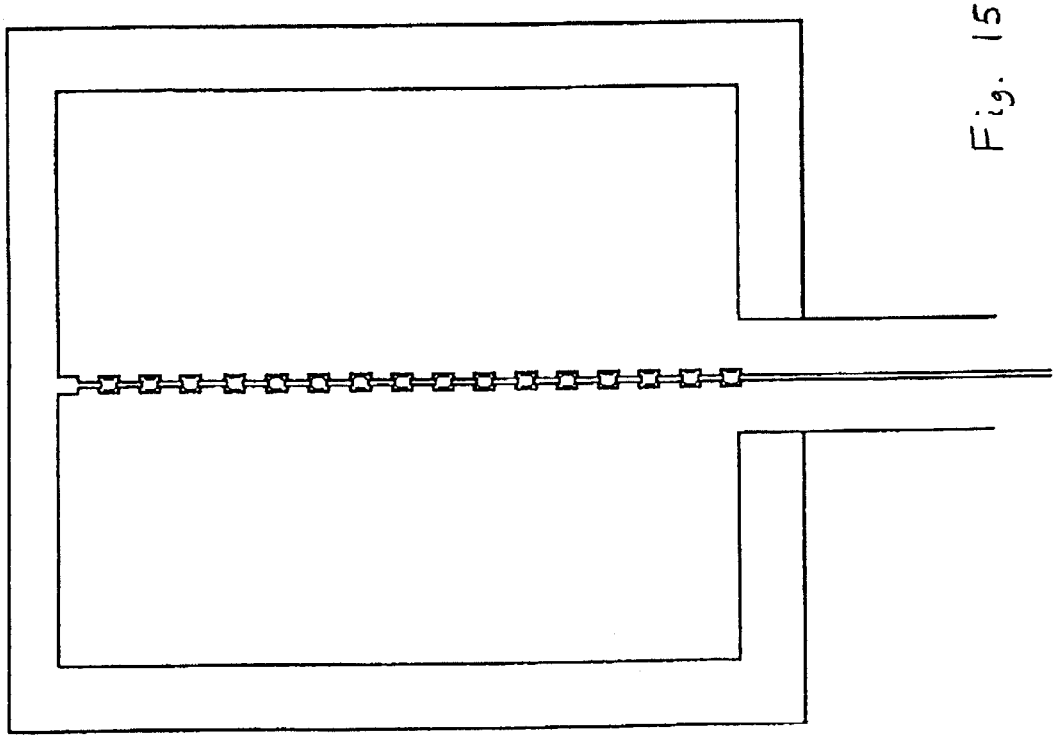
FIG. 15 is an overhead view of the slotted sensor of FIG. 14 with a column of black ink drops printed thereon.

In a method of using gap sensor 106, the position of sensor 106 is known and sensor 106 is placed in the print path of carrier 30. For the black alignment, carrier 30 (traveling from the left to the right) prints a single-pel-wide column of dots just to the left of gap 108. The printer then prints additional columns of dots in 1/1200-inch increasingly rightward increments until it reaches wider section 114 of gap 108, as seen in FIGS. 15 and 16. Sensor 106 is thereby triggered. The position that first triggers sensor 106 is noted by the printer and is saved for later use in performing alignments.

Figure 18:
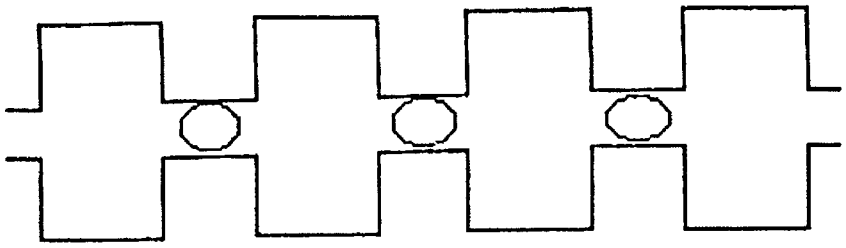
FIG. 18 is an enlarged, fragmentary, overhead view of the sensor of FIG. 17.
Figure 17:
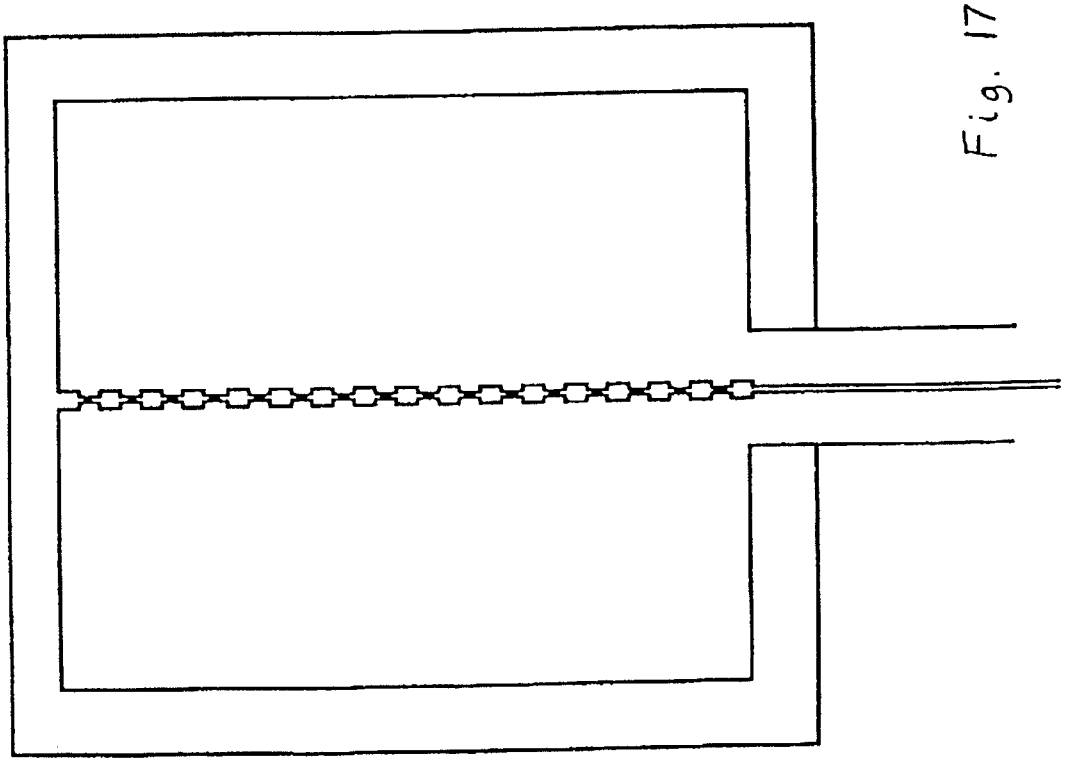
FIG. 17 is an overhead view of the slotted sensor of FIG. 14 with a column of color ink drops printed thereon.

Carrier 30 then travels from right to left and prints a single-pel-wide column of dots just to the right of gap 108. The printer then prints additional columns of dots in 1/1200-inch increasingly leftward increments until it reaches wider section 114 of gap 108, and sensor 106 is thereby triggered. The position that first triggers sensor 106 is again noted by the printer and is saved for later use in performing alignments. With the offsets, i.e., positions where the sensor is first triggered, being thus determined, the offsets can be used in an algorithm which aligns the black print head. For the color alignment, carrier 30, traveling from the left to the right, prints a single-pel-wide column of dots just to the left of gap 108. The printer then prints these columns of dots in 1/1200-inch increasingly rightward increments until it reaches narrower sections 116 of gap 108, as shown in FIGS. 17 and 18. Sensor 106 is thereby triggered. The position that first triggers sensor 106 is noted by the printer and is saved for later use in performing alignments.

Carrier 30 then travels from right to left and prints a single-pel-wide column of dots just to the right of gap 108. The printer then prints additional columns of dots in 1/1200-inch increasingly leftward increments until it reaches narrower section 116 of gap 108, and sensor 106 is thereby triggered. The position that first triggers sensor 106 is again noted by the printer and is saved for later use in performing alignments. With the offsets, i.e., positions where the sensor is first triggered, being thus determined, the offsets can be used in an algorithm which aligns the color print heads.

Figure 19:
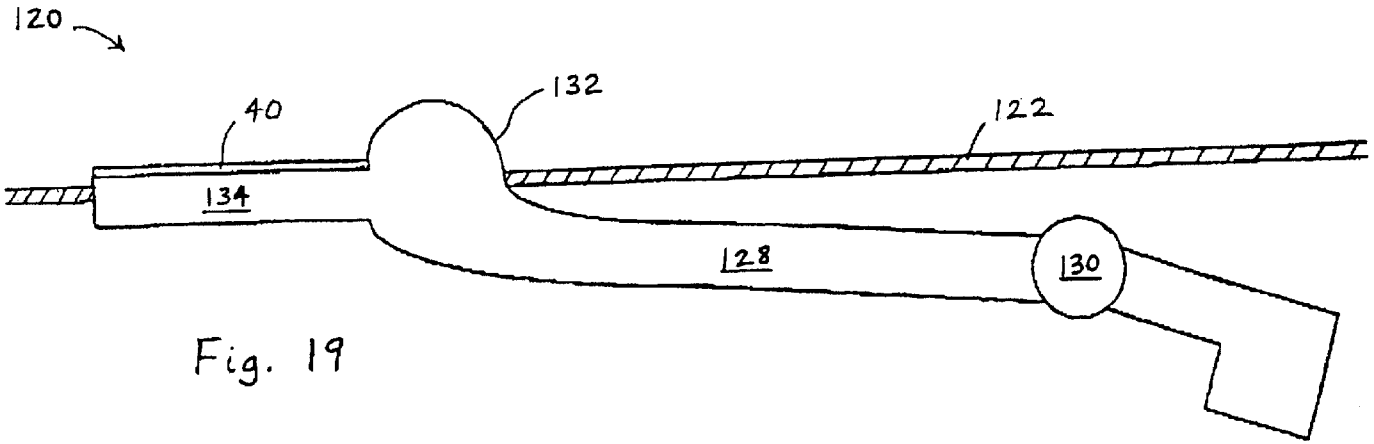
FIG. 19 is a schematic, side view of one embodiment of a sensor positioning mechanism of the present invention in a first position.
Figure 20:
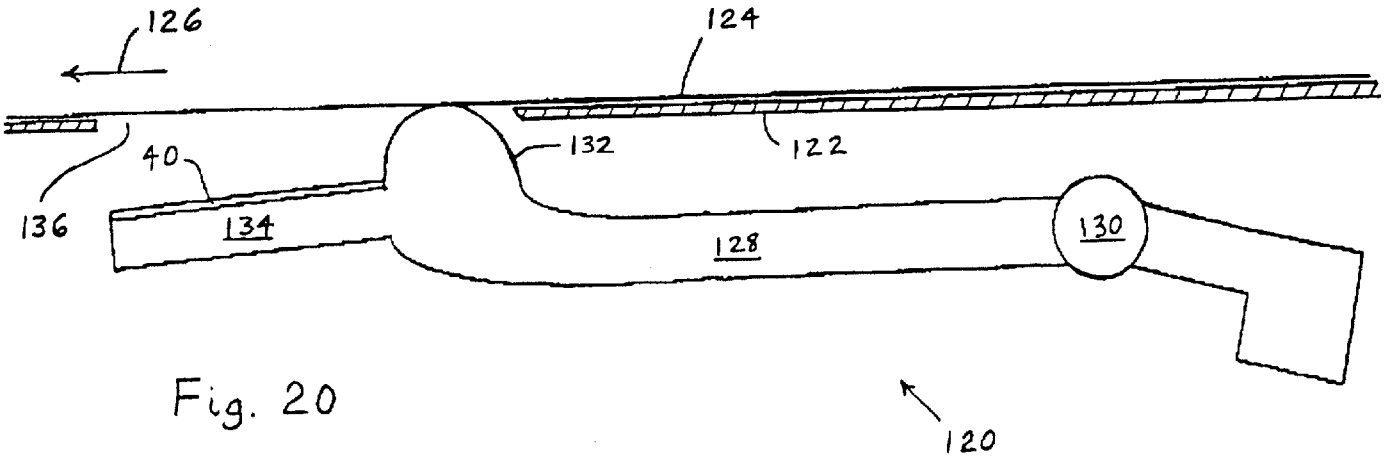
FIG. 20 is a schematic, side view of the sensor positioning mechanism of FIG. 19 in a second position.

An ink jet printer can include a sensor positioning mechanism 120 (FIG. 19) for moving a sensor of the present invention, such as sensor 40, between a first position (FIG. 19) and a second position (FIG. 20). In the first position, the sensor is placed at the surface height of the paper in the paper path. In the second position, the sensor is placed below the level of a platen 122 so as to not interfere with the movement of paper 124 in direction 126 along the paper path.

Mechanism 120 includes a lever arm 128 that rotates about pivot 130. A distal end of arm 128 has a slanted surface 132 and is attached to a sensor bed 134 for supporting sensor 40. In the first position of FIG. 19, the distal end of arm 128 is biased, perhaps by a spring (not shown), through an opening 136 in platen 122 such that sensor 40 is at the vertical level of paper 124 in the paper path. This is the operational position of sensor 40.

As a sheet of paper 124 proceeds along the paper path in direction 126, a leading edge of paper sheet 124 engages slanted surface 132 of arm 128 and pushes arm 128 downward into the second position of FIG. 20, a bottom surface of paper 124 engaging a line of contact at the top edge of slanted surface 132. The two opposite side edges of paper 124 are held taut in two respective nips between two respective pairs of rollers (not shown). The tautness of paper 124 overcomes the force of the spring and holds arm 128 in the second position. When paper 124 has moved beyond opening 136, arm 128 is released by paper 124 and arm 128 returns to the first position of FIG. 19.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead alignment sensor for an ink jet printer, said sensor comprising:

two terminals defining a substantially linear gap therebetween;

an ink support device configured to support ink in the gap between said terminals; and an electrical measuring device configured to detect a change in an electrical resistance between said terminals when ink is supported in the gap by said ink support device.

2. The sensor of claim 1, wherein said terminals are substantially electrically conductive.

3. The sensor of claim 1, wherein said electrical measuring device comprises an ohmmeter having leads connected to said terminals.

4. The sensor of claim 1, wherein said gap has a width approximately equal to a width of an ink drop.

5. The sensor of claim 4, wherein said gap width is approximately between 1/1200-inch and 1/600-inch.

6. The sensor of claim 1, wherein said ink support device comprises a substrate supporting said terminals.

7. The sensor of claim 1, wherein said electrical measuring device configured to detect a change in an electrical resistance between said terminals measures the resistance between said terminals.

8. A printhead alignment sensor for an ink jet printer, said sensor comprising:

a substrate having an elongate target area with a width approximately equal to a width of an ink drop; and a sensing device configured to detect when at least one ink drop is received on said target area.

9. The sensor of claim 8, further comprising a mask having an opening corresponding to and defining said target area.

10. The sensor of claim 8, further comprising a light source configured to emit light toward said target area.

11. The sensor of claim 10, further comprising a light detector configured to detect the light from said light source, the detected light being one of reflected off of said target area and transmitted through said target area.

12. The sensor of claim 8, wherein said sensing device includes one of a pressure sensor and a humidity sensor.

13. The sensor of claim 8, wherein said sensing device includes two conductive terminals on opposite sides of and defining said target area.

14. The sensor of claim 8, wherein said sensor is reused.

15. A printhead alignment sensor for an ink jet printer, said sensor comprising:

a plurality of aligned terminals, each pair of adjacent said terminals being separated by a corresponding substantially linear gap;

an ink support device configured to support ink in the gaps between said terminals; and an electrical measuring device configured to detect a change in an electrical resistance between said adjacent terminals when ink is supported in at least one of the gaps by said ink support device.

16. The sensor of claim 15, wherein each said gap is separated from each adjacent said gap by an integer multiple of a width of an ink drop.

17. The sensor of claim 15, wherein said electrical measuring device configured to detect a change in an electrical resistance between said adjacent terminals measures the resistance between said adjacent terminals.

18. A printhead alignment sensor for an ink jet printer, said sensor comprising:

a first terminal having a base and a plurality of tines extending therefrom;

a second terminal disposed between two adjacent said tines of said first terminal such that said second terminal and said adjacent tines define a pair of substantially linear gaps therebetween;

an ink support device configured to support ink in the gaps; and an electrical measuring device configured to detect a change in an electrical resistance between said first terminal and said second terminal when ink is supported in at least one of the gaps by said ink support device.

19. The sensor of claim 18, wherein said pair of gaps are substantially parallel.

20. The sensor of claim 18, wherein said second terminal includes a second base and a plurality of second tines extending therefrom, said second tines being interleaved with said tines of said first terminal.

21. The sensor of claim 18, wherein said electrical measuring device configured to detect a change in an electrical resistance between said first terminal and said second terminal measures the resistance between said first terminal and said second terminal.

22. A printhead alignment sensor for a multi-color ink jet printer, said sensor comprising:

a substrate having an elongate target area for receiving ink drops thereon, said target area having a length, said target area including a plurality of wide sections and a plurality of narrow sections, said wide sections and said narrow sections being alternatingly arranged along said length of said target area, a width of each said wide section being approximately equal to a width of a black ink drop, a width of each said narrow section being approximately equal to a width of a color ink drop; and a sensing device configured to detect when at least one ink drop is received on said target area.

23. The sensor of claim 22, wherein said sensing device includes a pair of conductive terminals separated by and defining said target area.

24. A method of aligning a printhead in an ink jet printer, said method comprising the steps of:

providing a substrate having a target area with a width approximately equal to a width of an ink drop;

moving a carrier of the printhead from a first location toward said target area;

jetting a plurality of aligned ink drops from the printhead when said carrier is at a jetting location, the aligned ink drops being substantially parallel to said target area;

sensing whether at least one of said ink drops has been jetted onto said target area;

returning said carrier to said first location;

repeating said moving, jetting, sensing and returning steps until at least one of said ink drops has been jetted onto said target area, each said jetting location being closer to said target area than an immediately preceding said jetting location; and recording a reference location of said carrier, said reference location being a location of said carrier when it is sensed that at least one of said ink drops has been jetted onto said target area.

25. The method of claim 24, wherein said jetting occurs while said carrier is in motion.

26. The method of claim 24, comprising the further step of supporting a pair of terminals on said substrate, said terminals defining said target area therebetween, said sensing step including measuring an electrical resistance between said terminals.

27. The method of claim 24, comprising the further steps of:

allowing said ink on said target area to at least one of dry and evaporate; and repeating said moving, jetting, sensing, returning repeating and recording steps.

28. A method of bi-directionally aligning a printhead in an ink jet printer, said method comprising the steps of:

providing a substrate having a target area with a width approximately equal to a width of an ink drop;

moving a carrier of the printhead in a first scan direction from a first location toward said target area;

jetting a plurality of aligned ink drops from the printhead when said carrier is at a first directional jetting location, the aligned ink drops being substantially parallel to said target area;

sensing whether at least one of said ink drops has been jetted onto said target area;

returning said carrier to said first location;

repeating said moving, jetting, sensing and returning steps until at least one of said ink drops has been jetted onto said target area, each said first directional jetting location being closer to said target area than an immediately preceding said first directional jetting location;

recording a first reference jetting location of said carrier, said first reference jetting location being a location of said carrier when it is sensed that at least one of said ink drops has been jetted onto said target area while said carrier is moving in said first scan direction;

moving said carrier in a second scan direction from a second location toward said target area, said second scan direction being substantially opposite to said first scan direction;

jetting a plurality of aligned ink drops from the printhead when said carrier is at a second directional jetting location, the aligned ink drops being substantially parallel to said target area;

sensing whether at least one of said ink drops has been jetted onto said target area;

returning said carrier to said second location;

repeating said second moving, jetting, sensing and returning steps until at least one of said ink drops has been jetted onto said target area, each said second directional jetting location being closer to said target area than an immediately preceding said second directional jetting location;

recording a second reference jetting location of said carrier, said second reference jetting location being a location of said carrier when it is sensed that at least one of said ink drops has been jetted onto said target area while said carrier is moving in said second scan direction; and using said first reference jetting location and said second reference jetting location to align ink jetted from the printhead when said carrier is moving in said first scan direction with ink jetted from the printhead when said carrier is moving in said second scan direction.

29. An ink jet printer, comprising:

at least one printhead; and a printhead alignment sensor including:

a substrate having an elongate target area with a width approximately equal to a width of an ink drop; and a sensing device configured to detect when at least one ink drop from said at least one printhead is received on said target area.

30. The ink jet printer of claim 29, further comprising a platen, said alignment sensor being disposed one of on and adjacent to said platen.

31. The ink jet printer of claim 29, further comprising a platen, said alignment sensor being movable between a first position substantially in a paper path of said printer and a second position out of the paper path.

32. An ink jet printer, comprising:

a sensor; and a positioning mechanism configured to allow said sensor to move between a first position substantially in a paper path of said printer and a second position out of the paper path.

33. The ink jet printer of claim 32, further comprising a platen having an opening, said sensor being configured to move through said opening between the first position and the second position.

* * * * *